United States Patent [19]

Scarborough et al.

[11] Patent Number: 4,807,602

[45] Date of Patent: Feb. 28, 1989

[54] FOOT MASSAGER

[76] Inventors: Roderick L. Scarborough; Diane Scarborough, both of 627 S. Walker St., Burgaw, N.C. 28425

[21] Appl. No.: 120,960

[22] Filed: Nov. 16, 1987

[51] Int. Cl.[4] ..... A61H 1/02

[52] U.S. Cl. ..... 128/52; 128/25 B

[58] Field of Search ..... 128/52, 51, 66, 25 B, 128/62 R, 24.2, 24.5, 24.1

[56] References Cited

U.S. PATENT DOCUMENTS

| | | | |
|---|---|---|---|
| 3,035,570 | 5/1962 | Nelson | D24/42 |
| 3,055,357 | 9/1962 | Redka | 128/25 B |
| 3,757,806 | 9/1973 | Bhaska et al. | 128/66 |
| 3,837,334 | 9/1974 | Johnson | 128/25 B |
| 3,939,825 | 2/1976 | Krummenacher | 128/25 B |
| 4,282,866 | 8/1981 | Miffitt | 128/66 |
| 4,523,580 | 6/1985 | Tureaud | 128/25 B |
| 4,620,529 | 11/1986 | Kurosawa | 128/25 B |

*Primary Examiner*—Edgar S. Burr
*Assistant Examiner*—Huong Q. Pham
*Attorney, Agent, or Firm*—Jerry T. Kearns

[57] ABSTRACT

A foot massager has an inclined floor on which a grid of upstanding rubber nipples are mounted. A pair of adjustable sprayers are mounted on the floor and spray water upwardly on the soles of a user's feet between the nipples. Water drains down the inclined floor and is recirculated to an enclosed water tank by a drainage hole at the base of the floor. The unit includes an adjustable pressure pump and a heating unit for controlling the temperature of the recirculating water. In a second embodiment, the nipples may be mounted on a reciprocating support plate for providing a massaging action to the soles of a user's feet. The supporting plate is reciprocated by an eccentric cam on the shaft of a rotary motor.

1 Claim, 4 Drawing Sheets

FOOT MASSAGER

BACKGROUND OF THE INVENTION

The present invention relates to foot massagers, and more particularly pertains to a new and improved foot massager which utilizes adjustable pulsating sprayers for spraying water upwardly between rubber feet supporting nipples. Various types of foot soaking and foot massaging devices are known in the prior art. However, none of these devices provide an adjustable pressure pulsating spray to the soles of an individual's feet. Through the use of the foot massaging device of the present invention, an adjustable water pressure pulsating spray is delivered to the soles of an individual's feet, creating a maximum amount of stimulation and enhanced blood circulation to the feet, as compared with conventional massaging devices which merely vibrate the water. The foot massaging device of the present invention also helps relieve foot aches and pains.

2. Description of the Prior Art

Various types of foot massagers are known in the prior art. A typical example of such a foot massager is to be found in U.S. Pat. No. Des. 126,849, which issued to J. Flatley on Apr. 29, 1941. This patent discloses an electrical vibrator for vibrating the soles of an individual's feet. U.S. Pat. No. Des. 157,306, which issued to E. Vogt on Feb. 14, 1950, discloses an electrical foot vibrator. No water circulation is utilized with this device. U.S. Pat. No. Des. 248,667, which issued to J. Plugge on July 25, 1978, discloses a hydromassage tank for the feet of an individual. U.S. Pat. No. Des. 269,636, which issued to F. MacGregor et al on July 5, 1983, discloses a foot massager having an inclined floor provided with a plurality of upstanding feet supporting nipples for engagement with the soles of an individual's feet. U.S. Pat. No. 3,083,709, which issued to F. Lengsfeld on Apr. 2, 1963, discloses a mechanical foot massaging and exercising device which utilizes adjacent pairs of rollers for engaging the soles and sides of an individual's feet. U.S. Pat. No. 3,276,060, which issued to D. Stokes, Jr. et al on Oct. 4, 1966, discloses a foot washing device which utilizes rotary brushes to wash the soles and top surfaces of an individual's feet.

While the above mentioned devices are suited for their intended usage, none of these devices provide a foot massager which utilizes an inclined floor provided with a plurality of feet supporting nipples in combination with adjustable pressure pulsating sprayers positioned to spray upwardly on the soles of an individual's feet between the rubber nipples. Additionally, none of the aforesaid foot massagers provide a recirculating water tank with a heating element and an adjustable pressure rotary vane type pump. Another feature of the present invention, not contemplated by the previously described prior art devices, is the use of a reciprocating nipple support plate actuated by an eccentric cam mounted on the drive shaft of a variable speed rotary motor to provide a mechanical foot massaging action. Inasmuch as the art is relatively crowded with respect to these various types of foot massagers, it can be appreciated that there is a continuing need for and interest in improvements to such foot massagers, and in this respect, the present invention addresses this need and interest.

SUMMARY OF THE INVENTION

In view of the foregoing disadvantages inherent in the known types of foot massagers now present in the prior art, the present invention provides an improved foot massager. As such, the general purpose of the present invention, which will be described subsequently in greater detail, is to provide a new and improved foot massager which has all the advantages of the prior art foot massagers and none of the disadvantages.

To attain this, representative embodiments of the concepts of the present invention are illustrated in the drawings and make use of a generally rectangular housing having a central compartment with an inclined floor supporting a plurality of upstanding feet engaging nipples. Adjustable pulsating sprayers are positioned to spray upwardly between the nipples onto the soles of a user's feet. A drain hole at the base of the inclined floor recirculates water to a water storage tank. An adjustable heating element in the tank allows for regulation of the water temperature. In a second embodiment of the present invention, the upstanding foot supporting nipples are secured to a reciprocating plate to provide a mechanical foot massaging action. The nipple supporting plate is reciprocated by an eccentric cam secured to the drive shaft of a rotary motor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot massager which has all the advantages of the prior art foot massagers and none of the disadvantages.

It is another object of the present invention to provide a new and improved foot massager which may be easily and efficiently manufactured and marketed.

It is a further object of the present invention to provide a new and improved foot massager which is of a durable and reliable construction.

An even further object of the present invention is to provide a new and improved foot massager which is susceptible of a low cost of manufacture with regard to both materials and labor, and which accordingly is then susceptible of low prices of sale to the consuming public, thereby making such foot massagers economically available to the buying public.

Still yet another object of the present invention is to provide a new and improved foot massager which provides in the apparatuses and methods of the prior art some of the advantages thereof, while simultaneously overcoming some of the disadvantages normally associated therewith.

Still another object of the present invention is to provide a new and improved foot massager which utilizes adjustable pulsating sprayers to spray water on the soles of an individual's feet which are supported by upwardly extending rubber nipples.

Yet another object of the present invention is to provide a new and improved foot massager which utilizes an adjustable heating element to control the temperature of recirculated water which is sprayed upwardly between rubber feet supporting nipples onto the soles of an individual's feet.

Even still another object of the present invention is to provide a new and improved foot massager which utilizes a reciprocating nipple supporting plate to provide a mechanical foot massaging action to the soles of an individual's feet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention Will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
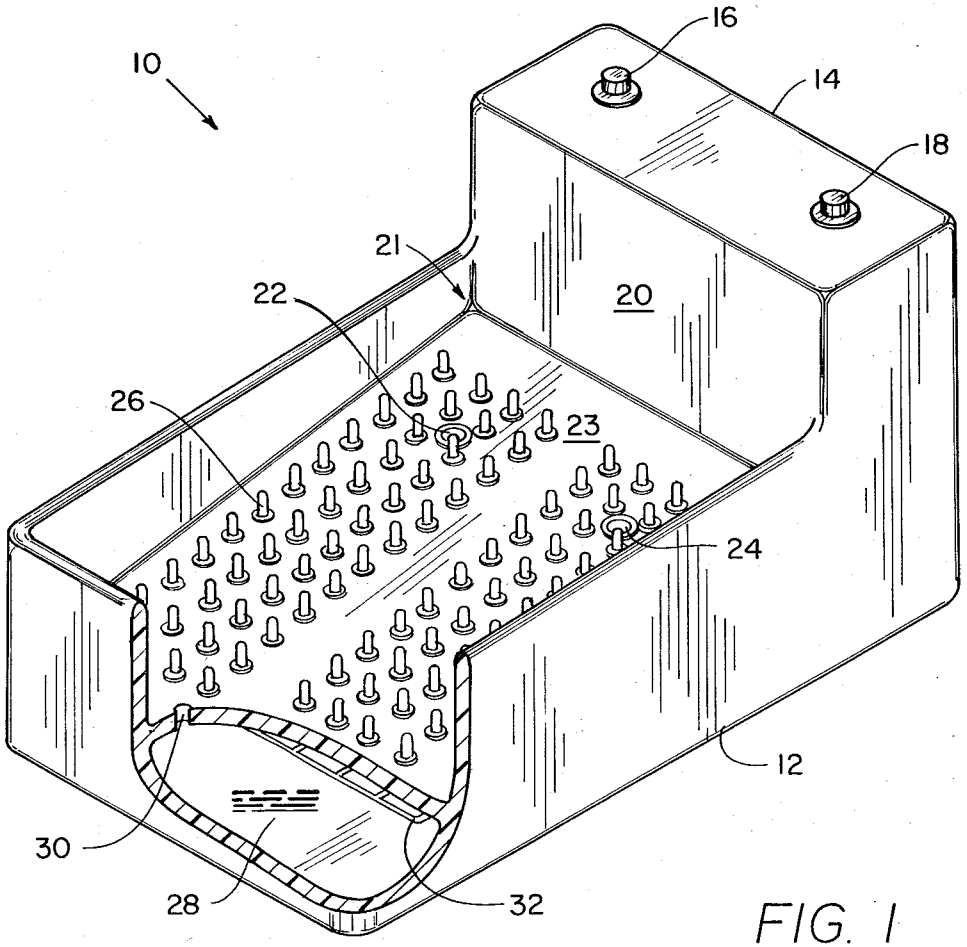
FIG. 1 is a perspective view, partially cut away, illustrating a foot massaging device according to the first embodiment of the present invention.

With reference now to the drawings, and in particular to FIG. 1 thereof, a new and improved foot massager embodying the principles and concepts of the present invention and generally designated by the reference numeral 10 will be described.

More specifically, it will be noted that the first embodiment 10 of the invention includes a generally rectangular housing 12 having an upstanding control and pump housing section 14. A first control knob 16 is provided for actuation of an adjustable water heating element 32. A second control knob 18 is provided for actuation of a variable speed rotary electric vane type pump within the housing section 14. A vertical wall 20 of the pump housing section 14 faces a foot receiving compartment area 21 of the housing 12. A plurality of adjustable pulsating type sprayers 22 and 24 extend through an inclined floor 23 in the housing 12. Although only two adjustable pulsating sprayers are illustrated, it should be understood that it is contemplated that as many sprayers as desired may be spaced along and about the inclined floor 23. Also mounted on the inclined floor 23 are a plurality of spaced upstanding nipples 26 formed from a soft rubber material. A drain hole 30 formed through a low point on the inclined floor 33 communicates with a water storage tank 28. An adjustable heating element 32 is positioned in the water storage tank 28. The heating element 32 may be of the electrical resistance type. In use, an individual's feet are placed within the foot receiving area 21 of the housing 12, with the soles of the individual's feet supported by the upstanding nipples 26. The temperature of the water in the storage tank 28 is adjusted to the desired temperature by manipulation of the control knob 16 and actuation of the heating element 32. A conventional type of thermostatic control may be received within the housing section 14 for maintaining the water in the storage tank 28 at a preselected level. An electrical rotary variable speed vane type pump within the housing section 14 is then actuated by manipulation of a control knob 18. This results in a pulsating water spray through the spray nozzles 22 and 24. The nozzles 22 and 24 may be adjusted to give the desired spray in conjunction with adjustment of the pump speed by control knob 18.

Figure 2:
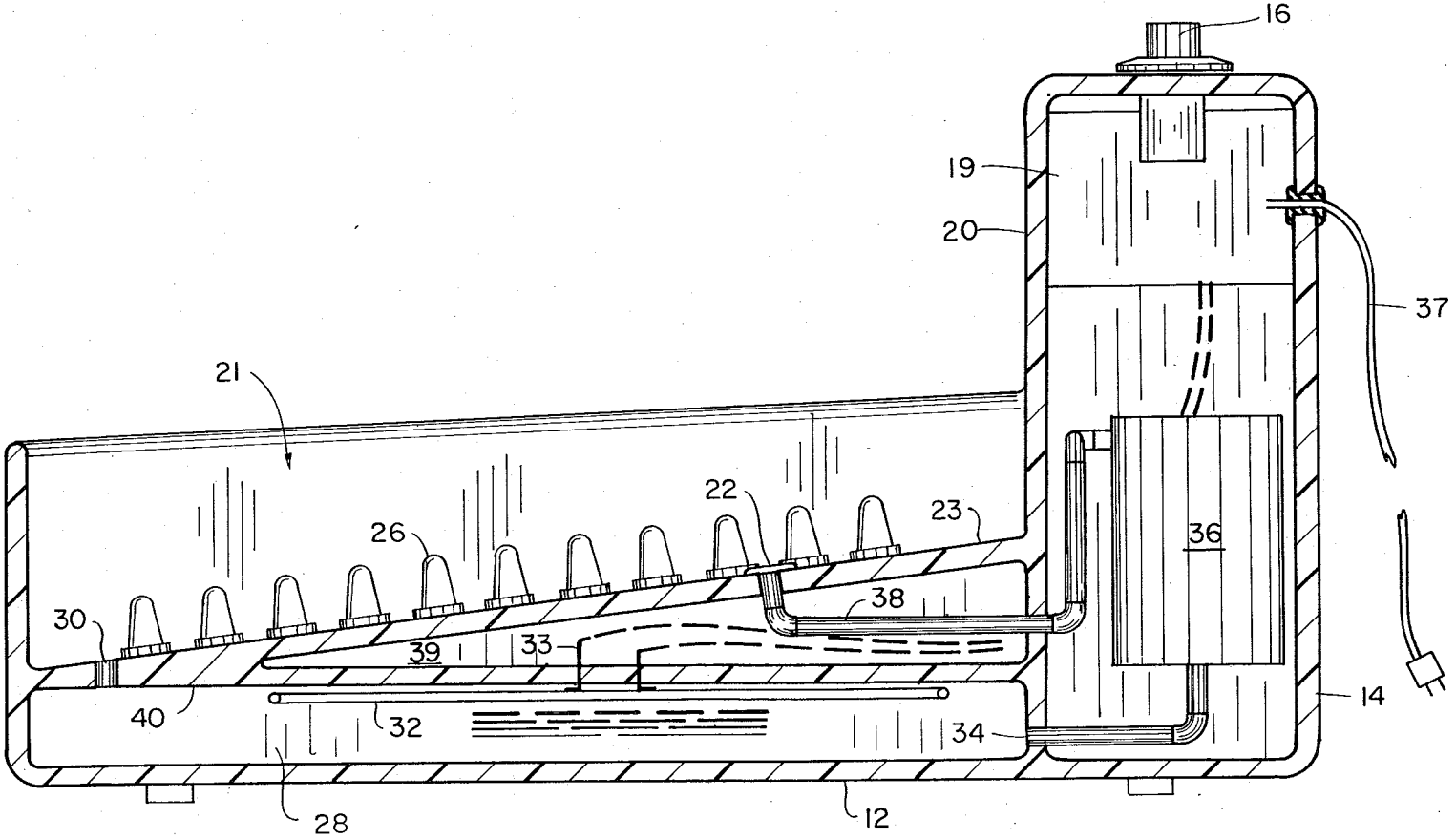
FIG. 2 is a cross sectional view illustrating the internal mechanisms of the foot massaging device of the first embodiment of the present invention.

With reference now to FIG. 2, a longitudinal cross sectional view of the foot massaging device 10 of the first embodiment of the present invention is provided. It may be seen that the upstanding nipples 26 are mounted on the inclined floor 23. A variable speed electric rotary vane type pump 36 is mounted within the housing section 14 of the housing 12. The pump has an inlet 34 connected to the water supply tank 28 and an outlet 38 connected to supply high pressure water to the pulsating sprayers 22 and 24. A conventional electrical supply cord 37 supplies electric power to conventional controls in a control box 19 for the control and actuation of the pump 36, and the heating element 32. These control functions are achieved by conventional electrical switches and rheostats, the details of which form no part of the present invention and thus further discussion is deemed unnecessary.

Figure 3:
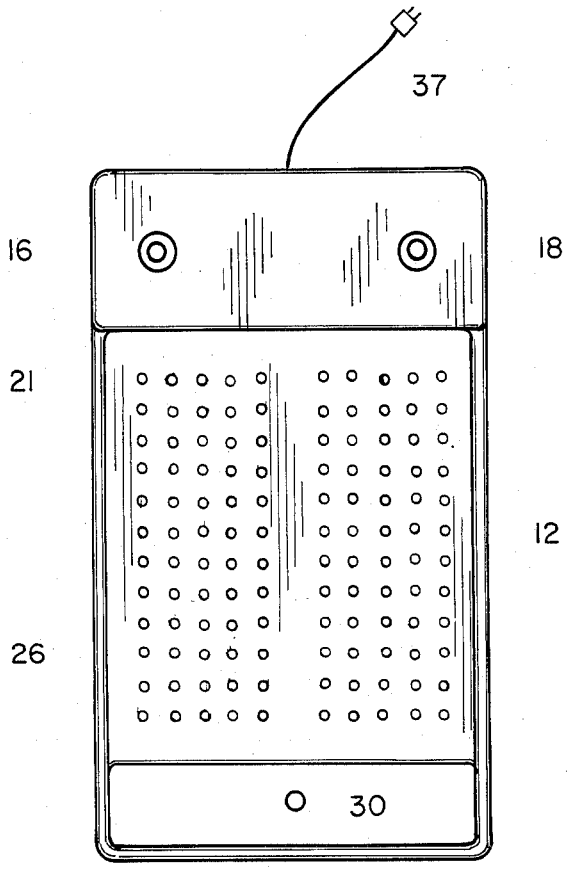
FIG. 3 is a top plan view of the foot massaging device according to the first embodiment of the present invention.

With reference now to FIG. 3, a top plan view of the foot massaging device 10 of the first embodiment of the present invention is provided.

Figure 4:
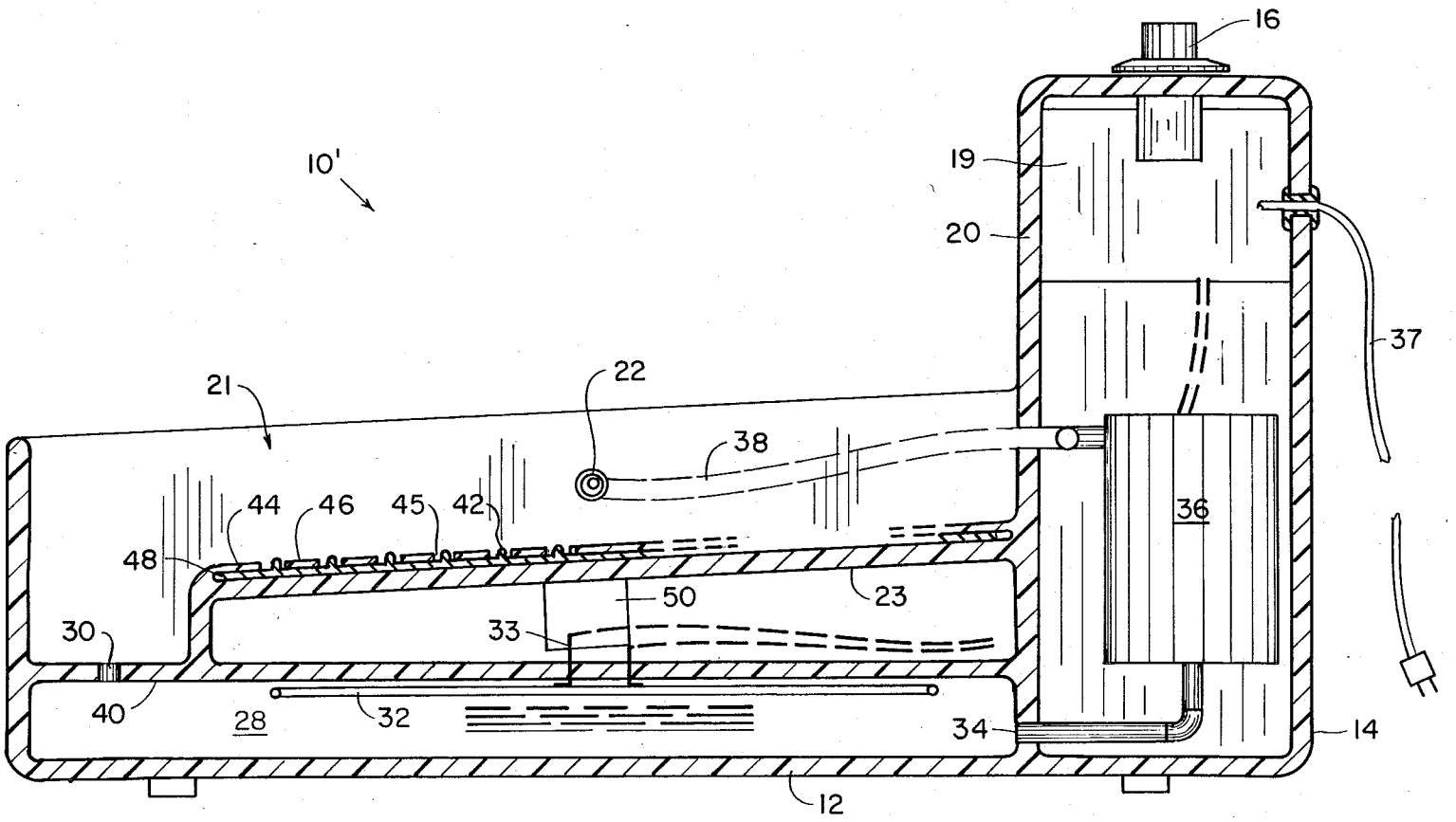
FIG. 4 is a cross sectional view illustrating the internal mechanisms of a foot massaging device according to a second embodiment of the present invention.

In FIG. 4, a longitudinal cross sectional view of a second embodiment 10' of a foot massaging device according to the present invention will now be described. The second embodiment 10' is constructed in a generally similar fashion as the first embodiment 10, and like parts are designated by the same reference numerals utilized with respect to the description of the various components of the first embodiment. In the second embodiment, the adjustable pulsating sprayers 22 are arranged to spray upon the tops and sides of an individual's feet. A reciprocating plate 44 supports a plurality of spaced upstanding foot supporting nipples 42 formed from a soft rubber material. The reciprocating nipple supporting plate 44 is slidably received in a slot 48 formed in the inclined floor 23. The upstanding nipples 42 are received for reciprocating longitudinal movement through slots or apertures 45 in an overlying cover plate 46. A rotary electric motor 50 actuates the nipple supporting plate 44 for reciprocating longitudinal motion by a mechanism to be subsequently described.

Figure 5:
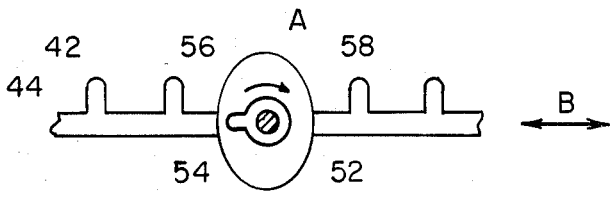
FIG. 5 is a detail view illustrating the cam mechanism for reciprocating the nipple supporting plate of the foot massaging device of the second embodiment of the present invention.

With reference now to FIG. 5, a side detail view is provided illustrating the mechanism for reciprocating the nipple supporting plate 44. The upstanding nipples 42 are mounted for longitudinal reciprocation with the supporting plate 44 in the directions indicated by the arrow B. An oval cup shaped recessed cam track 58 is rigidly secured to the support plate 44. A circular cam 54 having an eccentric lobe 56 is rigidly secured to a drive shaft 52 of the rotary electric motor 50 (FIG. 4) for rotation in the direction indicated by the arrow A. Due to the oval shape of the cam track recess 58, the cam lobe 56 will reciprocate the support plate 44 a limited distance in each direction upon each complete revolution of the drive shaft 52. It is contemplated that the rotary electric motor 50 will be a variable speed electric motor whereby the frequency of reciprocation of the supporting plate 44 will be adjustable, thereby providing an adjustable mechanical massaging motion to the feet supporting nipples 42.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foot massager, comprising:

a housing;

a foot receiving compartment in said housing;

an inclined floor in said foot receiving compartment;

a plurality of spaced apertures formed through said inclined floor;

a slot extending parallel with and beneath an upper surface of said inclined floor;

a nipple support plate provided with a plurality of spaced upstanding nipples;

said nipples formed from a flexible rubber material;

said nipple support plate received for limited reciprocal sliding movement in said slot, with said nipples extending upwardly through said apertures;

an oval recessed cam truck rigidly secured to said nipple support plate;

a variable speed rotary electrical motor;

an eccentric cam secured to a drive shaft of said rotary electrical motor;

an eccentric lob on said cam engaging said oval cam recess for reciprocating said nipple support plate;

a plurality of adjustable pulsating spray nozzles arranged in said foot receiving compartment for spraying an individual's feet when supported on said inclined floor;

a drain hole at a low point in said inclined floor;

a water storage tank beneath said inclined floor communicating with said drain hole;

an adjustable heating element in said water storage tank; and an adjustable variable speed rotary pump connected for supplying water from said water storage tank to said spray nozzles.

* * * * *